US005883334A

United States Patent [19]

Newmoyer et al.

[11] Patent Number: 5,883,334

[45] **Date of Patent: *Mar. 16, 1999**

[54] HIGH SPEED TELECOMMUNICATION CABLE

[75] Inventors: Kerry Newmoyer, Denver; Eric Lawrence, Terre Hill, both of Pa.

[73] Assignee: Alcatel NA Cable Systems, Inc., Claremont, N.C.

[ * ] Notice: The term of this patent shall not extend beyond the expiration date of Pat. No. 5,519,173.

[21] Appl. No.: 910,309

[22] Filed: Aug. 13, 1997

Related U.S. Application Data

[63] Continuation of Ser. No. 489,799, Jun. 13, 1995, abandoned.

[51] Int. Cl.[6] ..... H01B 11/02

[52] U.S. Cl. ..... 174/113 R; 174/27; 174/113 C

[58] Field of Search ..... 174/34, 36, 113 R, 174/113 A, 113 C, 131 A, 27

[56] References Cited

U.S. PATENT DOCUMENTS

| | | | |
|---|---|---|---|
| 445,234 | 1/1891 | Reilly | 174/34 |
| 473,267 | 4/1892 | Sawyer | 174/34 |
| 1,305,247 | 6/1919 | Beaver et al. | 174/27 |
| 1,627,740 | 5/1927 | Hosford | 174/36 |
| 1,856,204 | 5/1932 | Affel et al. | 174/28 |
| 1,978,419 | 10/1934 | Dudley | 174/28 |
| 2,014,214 | 9/1935 | Smith | 174/34 |
| 2,488,211 | 11/1949 | Lemon | 174/28 |
| 2,761,893 | 9/1956 | Morrison | 174/116 |
| 2,804,494 | 4/1957 | Fenton | 174/113 R |
| 3,227,801 | 1/1966 | Demmel | 174/34 |
| 3,644,659 | 2/1972 | Campbell | 174/27 |
| 3,678,177 | 7/1972 | Lawrenson | 174/113 C |
| 4,084,065 | 4/1978 | Swenson | 174/70 R X |
| 4,549,041 | 10/1985 | Shingo et al. | 174/113 R |
| 4,767,890 | 8/1988 | Magnan | 174/28 |
| 4,869,848 | 9/1989 | Hasegawa et al. | 174/113 R |
| 4,945,342 | 7/1990 | Steinemann | 174/113 R |
| 4,959,266 | 9/1990 | Ueno et al. | 174/113 R X |
| 5,149,915 | 9/1992 | Brunker et al. | 174/36 |
| 5,444,184 | 8/1995 | Hassel | 174/113 R |
| 5,448,669 | 9/1995 | Dunn et al. | 385/101 X |
| 5,519,173 | 5/1996 | Newmoyer et al. | 174/113 R |

FOREIGN PATENT DOCUMENTS 7807175 1/1980 Netherlands .

*Primary Examiner*—Kristine Kincaid
*Assistant Examiner*—Chau N. Nguyen
*Attorney, Agent, or Firm*—Ware, Fressola, Van der Sluys & Adolphson LLP

[57] ABSTRACT

A high speed telecommunication cable includes at least two soft supports, such as a flame retardant polypropylene material, each having a plurality of embedded twisted pair conductors disposed therein and a plurality of wrapped twisted pair conductors disposed about the periphery thereof.

14 Claims, 1 Drawing Sheet

HIGH SPEED TELECOMMUNICATION CABLE

This application is a continuation of application(s) Ser. No. 08/489,799 filed on Jun. 13, 1995, now abandoned.

BACKGROUND OF THE INVENTION

The present invention generally relates to a high frequency, high performance telecommunication cable for commercial building applications and, in particular, relates to one such high frequency telecommunication cable including a plurality of twisted pair conductors disposed about a plurality of soft support means.

Historically, early telecommunication cable designs have suffered from the dynamic, inductive effects of parallel and adjacent conductors. Also generally known as "crosstalk", this problem becomes even more severe at high frequencies or high data rates and over long distances. Thus, crosstalk effectively limits the frequency range, bit rate, cable length, signal to noise ratio as well as the number of conductor pairs which can be used within a single cable for signal transmission. Further, the higher the number of potentially "energized" conductors or pairs there are in the cable, the more potential exists for crosstalk interference. Crosstalk can be even more pronounced in bi-directional transmission cables. Generally known as "near end crosstalk", the effect is particularly noticeable at either end of the cable where signals returning from the opposite end are weak and easily masked by interference. It quickly became known in the art that crosstalk could be better controlled by separating parallel and adjacent transmission lines or by transposing the signals along the cable to minimize the proximity of any two signals. For example, U.S. Pat. No. 445,234 issued to Reilly on Jan. 27, 1891, discloses a single conductor arrangement where signals are transposed at various locations along the length of cable so that no two conductors would occupy the same relative positions. Although physically separating conductors sufficiently to limit crosstalk in a single, compact cable proved difficult, several such designs emerged. For example, U.S. Pat. No. 473,267, issued to Sawyer on Apr. 19, 1892, describes a technique for braiding single conductors to maintain spacing among adjacent conductors and thereby reduce capacitance and reduce strain. Similarly, U.S. Pat. No. 1,305,247, issued to Beaver, et al. on Jun. 3, 1919, describes the use of a rubber insulator between two conductors for adding elasticity without damaging the conductors. Subsequent designs, such as that disclosed in U.S. Pat. No. 1,856,204, issued to Affel, et al. on May 24, 1930, described conductor arrangements for providing spare conductors for special services. Nevertheless, the problem of crosstalk remained a major problem for cable makers and users.

As a result, efforts to reduce crosstalk between adjacent conductors or pairs continued. For example, U.S. Pat. No. 1,978,419, issued to Dudley on Oct. 30, 1934, discloses the use of bundled coaxial conductors for supporting bi-directional transmission of signals having similar frequencies while minimizing near end crosstalk. However, coaxial cables tend to be quite large, particularly for large numbers of conductors. Still other techniques were used to achieve improved cable performance such as the use of heavy gauge conductors and special twining or twisting techniques as disclosed in the U.S. Pat. No. 2,014,214, issued to Smith on Sep. 10, 1935.

Spacers or fillers have been used as part of cable configurations for maintaining spacing of conductors. For example, U.S. Pat. No. 2,488,211, issued to Lemon on Nov. 15, 1949, discusses and describes the use of a filler arranged around a central multi-strand conductor for maintaining separation between the central conductor and a surrounding metallic screen in a high frequency cable. Further, U.S. Pat. No. 2,761,893, issued to Morrison on Sep. 4, 1956, discusses the use of a central filler made of fibrous jute in a travelling electrical cable to provide enhanced mechanical balance.

In addition to incorporating various fillers in cables to enhance electrical characteristics, special routing of conductors inside a cable has been used to reduce crosstalk. In particular, U.S. Pat. No. 3,227,801, issued to Demmel on Jul. 4, 1966, describes the technique of using a precise conductor crossing method whereby the distance over which any two conductors are adjacent is minimized.

In addition, various dielectric materials have been used inside cables to enhance electrical characteristics. For example, in U.S. Pat. No. 2,804,494, issued to Fenton on Apr. 8, 1953, conductors of a high frequency transmission line are separated by air, acting as a dielectric, to reduce noise pickup. However, it should be noted that Fenton addresses the problem of external interference and not crosstalk between adjacent conductors within the same cable.

Still other techniques have been employed for maintaining a particular conductor geometry. For example, in U.S. Pat. No. 3,644,659, issued to Campbell on Feb. 22, 1972, resilient filler strings are used as a central core to hold a surrounding layer of conductors against an outer shield. The objective in Campbell's cable is to maintain firm contact between the conductors and the outer shield, even while being flexed, for maintaining a tight tolerance on impedance. Similarly, U.S. Pat. No. 3,678,177, issued to Lawrenson on Jul. 18, 1972, also describes the use of a central filler surrounded by conductor pairs all contained within an outer shield. Therein, Lawrenson discusses the use of dielectric spacers between pairs of conductors rather than the use of tightly twisted pairs. U.S. Pat. No. 4,767,890, issued to Magnan on Aug. 30, 1988, also discusses the use of a central filler, around which conductors are arranged for reducing the "skin effect" across the audio frequency range.

Conventional high frequency telecommunication cable configurations generally employ unshielded twisted pairs (UTP) as the primary cable component. Although many configurations are used in the industry, typical configurations include four twisted pairs and are performance rated by impedance, attenuation and near end crosstalk.

Contemporary commercial building cabling standards facilitate planning and installation of cabling by establishing performance and technical requirements for various system configurations. The most rigid of these standards define specifications for cabling intended to support a broad range of telecommunication services including voice, data, video, and the like.

More recently, the rapid growth in telecommunications, and in particular local area networks, has sparked an increase in demand for high capacity, high performance, high frequency telecommunications cable. To meet this demand, contemporary cable configurations incorporate higher pair counts to make more efficient use of cable space. However, recent industry standards for cables with higher pair counts are more rigorous than standards for lower pair count, such as 4 pair cables. Most significantly, the crosstalk requirement changes from a worst pair requirement to a power sum type requirement which is more far difficult to attain.

Specifically, unlike the traditional Near End Crosstalk (NEXT) standard which identifies and quantifies the worst pair-to-pair combination in the cable, the Power Sum Near End Crosstalk (PSNEXT) standard of a specific pair is the mathematical pair-to-pair near end crosstalk contributions of all other pairs in the cable into that pair. Consequently, PSNEXT determines each twisted pair's resistance to coupled power from all other pairs, summed on a power basis, when all the pairs are simultaneously energized. Such a stringent standard is now used in a network environment where multiple high frequency or high data rate transmissions are employed in a single cable, as can be seen when the cable is used as a backbone for a network, or networks, as part of a structured cabling system.

It is well known in the art that the factors most affecting near end crosstalk are resistive or inductive unbalances, distance between the disturbing and disturbed (or listening) pairs and careful lay length selection. However, even with this knowledge, cable configurations with large twisted pair counts, typically greater than four have been unable to meet the requisite PSNEXT requirements. Alternative approaches such as bundled four pair cables, each with its own jacket with or without an overall jacket, tend to be difficult to manage and install.

One recent approach that provides a cable having a high number of twisted pair count with a superior power sum crosstalk performance is described in U.S. Pat. No. 5,519,173, issued on May 21, 1996, entitled High Speed Telecommunication Cable and assigned to the assignee hereof. This patent application is hereby incorporated herein by reference. The design described in the above-identified patent application provides a high speed, high performance telecommunications cable having a higher twisted pair count while maintaining superior power sum crosstalk performance. However, it has been found that because of the use of filler members about which the twisted pairs of electrical conductors are wrapped, the cable described in this patent application can be relatively expensive. That is, not only is there the expense of the filler members themselves but the cross-sectional size resulting from wrapping all of the twisted pairs of electrical conductors about the filler members of the cable increases the cost of the resultant cable.

Consequently, a relatively inexpensive, high speed, high performance telecommunications cable having a higher twisted pair count while maintaining superior power sum crosstalk performance is highly desirable.

SUMMARY OF THE INVENTION

Accordingly, it is one object of the present invention to provide a relatively inexpensive, high speed, high performance telecommunication cable with a large twisted pair conductor count and superior power sum near end crosstalk performance.

The foregoing object is accomplished, at least in part, by a high speed, high performance telecommunication cable wherein a first plurality of twisted pair conductors are selectively spaced and disposed within a plurality of soft support means and a second plurality of twisted pair conductors are disposed and wrapped around the periphery of the plurality of soft support means.

Other objects and advantages will become apparent to those skilled in the art from the following detailed description read in conjunction with the appended claims and drawings attached hereto.

BRIEF DESCRIPTION OF THE DRAWINGS

The drawing, not drawn to scale, includes.

DETAILED DESCRIPTION OF THE INVENTION

Figure 1:
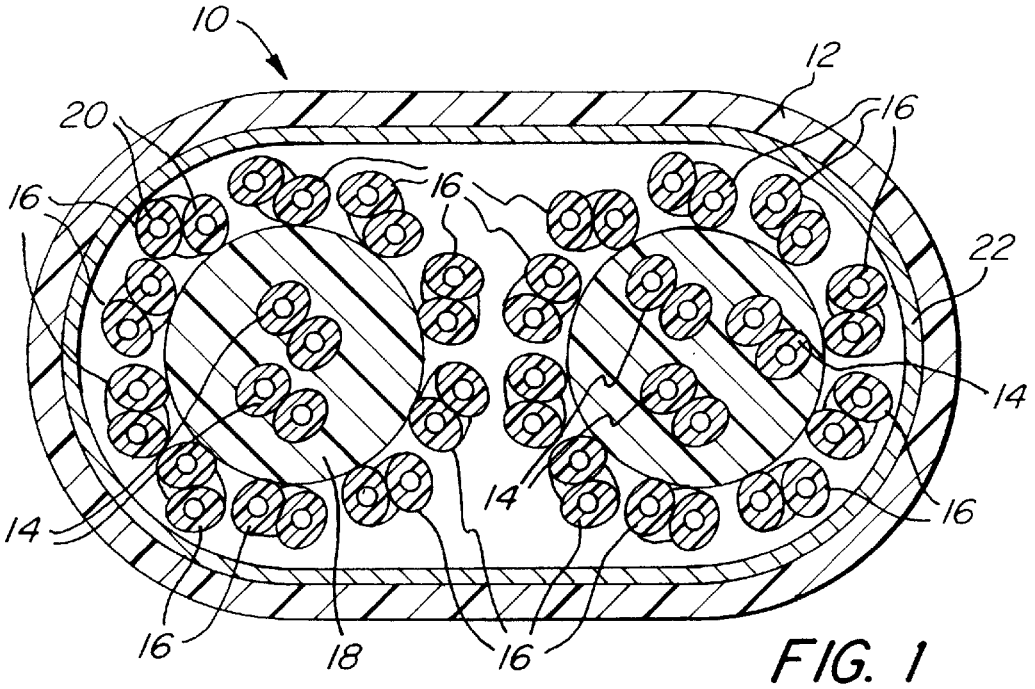
FIG. 1 which is a cross-sectional end view of a high frequency telecommunication cable embodying the principles of the present invention.

A high frequency telecommunication cable, generally indicated at 10 in FIG. 1 and embodying the principles of the present invention, includes a jacket 12, a plurality of embedded twisted pair conductors 14, a plurality of wrapped twisted pair conductors 16, and a plurality of soft support means 18 within the jacket 12 for encompassing the twisted pair conductors 14 and for supporting the plurality of wrapped twisted pair conductors 16. As used herein the phrase "soft support means" or the idiomatic variations thereof are taken to include materials within which a few twisted pairs conductors may be embedded and about which twisted pairs of conductors may be wound.

In one preferred embodiment, the high frequency telecommunication cable 10, the wrapped twisted pair conductors 16 of the high frequency telecommunication cable 10 are helically wound around the soft support means 18. The direction of the twisted pair conductors 16 or helical winding about the support means 18 may be left hand or right hand.

In one preferred embodiment, the jacket 12 is made of a flexible electrically insulating material, such as, for example, a fluropolymer, PVC, an olefin, or a polymer alloy.

Each of the twisted pair conductors, 14 and 16, is provided with an insulating layer 20. Typically, the insulating layer 20 is a plastic material, such as, for example, polyolefin, flame retardant polyolefin, fluropolymer, PVC, or a polymer alloy.

Figure 3:
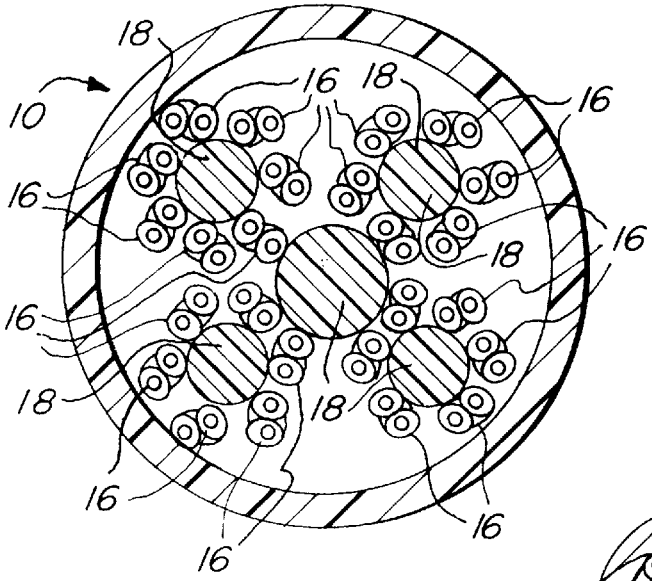
FIG. 3 which is a cross-sectional end view of still another high frequency telecommunication cable also embodying the principles of the present invention.
Figure 2:
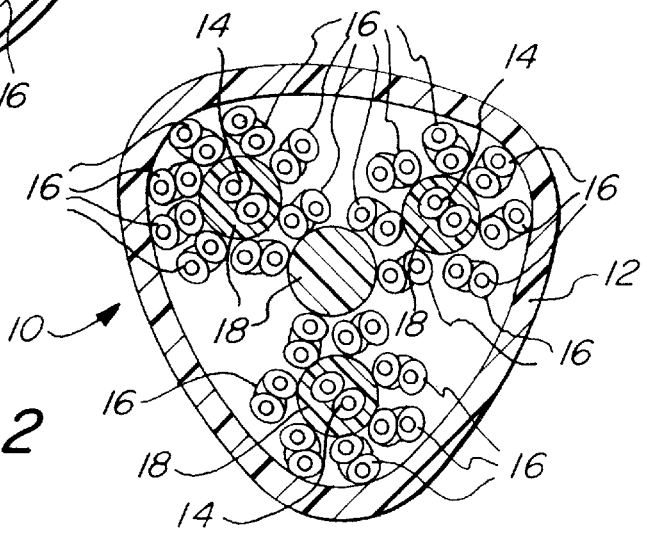
FIG. 2 which is a cross-sectional end view of a high frequency telecommunication cable embodying the principles of the present invention.

In the embodiment shown in FIG. 1, the plurality of embedded twisted pair conductors 14 are embedded within two separate soft support means 18. As shown in FIG. 2, the plurality of twisted pair conductors 14 are embedded within three separate soft support means 18 which themselves separated by a fourth separate soft support means 18. Further, as shown in the embodiment set forth in FIG. 3, the cable is provided with five soft support means 18. The exact arrangement of embedded twisted pairs 14 to the wrapped twisted pair conductors 16 is a matter of design choice. However, in one preferred embodiment, the arrangement is such that the soft support means 18 and the embedded twisted pair conductors 14 form a round diameter around which the wrapped twisted pair conductors 16 will comfortably settle. That is, there should be no residual gap in the sequence of the wrapped twisted pair conductors 16 nor should the wrapped twisted pair conductors 16 be so congested that one or more twisted pairs of conductors 16 gets pushed out from the remainder of the wrapped twisted pair of conductors 16.

As shown in FIG. 1, although it is not necessary, the plurality of wrapped twisted pair conductors 16 is separated into a number of groups that is equal in number to the number of individual soft support means 18. Each group is then helically wrapped, in a single layer, about one of the soft support means 18. Preferably, although not necessary, the number to wrapped twisted pair conductors 16 is the same for each group. The embodiment shown in FIG. 1 includes two soft support means 18 and two groups of wrapped twisted pair conductors 16 each group containing 10 twisted pairs. The embodiment shown in FIG. 2 includes three soft support means 18, each having one embedded twisted pair of conductor 14. In this embodiment, the three soft support means 18, individually having seven, seven and eight wrapped twisted pair conductors 16 thereabout, surround a fourth soft support means 18. The embodiment shown in FIG. 3, the four soft support means 18, each having six, six, six and seven wrapped twisted pair conductors 16 thereabout, surround a fifth soft support means 18. Clearly, many combinations are available without departing from the scope of this invention.

Preferably, each of the soft support means 18 is disposed within the jacket 12 such that each is equidistant from every other one of the soft support means 18. Although any number of individual soft support means 18 can be included, the preferred embodiment includes two soft support means 18. The soft support means 18 can be formed from any material that will allow the embedded twisted pair of conductors 14 to be disposed therein. For example, the material of the soft support means 18 can be fibrillated flame retardant polypropylene, Kevlar, cotton, jute, glass, nomex, polyester, nylon, or the like.

In addition, as shown in FIG. 1, the cable 10 can also include a layer 22 of shielding material between the plurality of wrapped twisted pairs of conductors 16 and the jacket 12. Such a layer of shielding material 22 can be formed from an electrically conductive material such as aluminum or other metal or metal braid.

By use of the arrangements discussed herein, it will be understood that because some of the twisted pairs are embedded within the soft support means 18 the overall diameter of the cable 10 is reduced and becomes less expensive than conventional cables 10. Further, the selection of the material for the soft support means 18 can be made to ensure that the cable 10 not only meets the requisite electrical requirements but is relatively inexpensive.

In one specific embodiment of the invention, the jacket is preferably made of fluorocopolymer, having a nominal thickness of 0.015 inches and a nominal diameter of 0.580 inches. In addition, each of the members of the plurality of twisted pair conductors are preferably copper, have a nominal diameter of 0.020 inches with a nominal insulation thickness of 0.007 inches.

As will be appreciated from the description provided herein, the present invention offers several advantages over the prior art. For example, the cable 10 is lightweight and compact while containing a large twisted pair conductor count. Also, the cable 10 is flexible and fire retardant. In addition, the cable 10 is simple to manufacture and is compatible with existing industry standards defining component, installation and cable performance.

Although the present invention has been described and discussed herein with respect to one or more embodiments, other arrangements or configurations may also be used that do not depart from the spirit and scope hereof. Hence, the present invention is deemed limited only by the appended claims and the reasonable interpretation thereof.

What is claimed is:

1. A high speed telecommunication cable comprising:

a cable core including:

soft support means;

a first plurality of twisted pair conductors selectively spaced and embedded within said soft support means;

a second plurality of twisted pair conductors positioned on a periphery of said soft support means and not embedded within said soft support means, wherein said soft support means supports said second plurality of twisted pair conductors;

each twisted pair conductor including a pair of electrical conductors each of said conductors surrounded by a layer of insulation material; and a cable jacket surrounding said cable core.

2. The high speed telecommunication cable as claimed in claim 1 further comprising: a layer of shielding material between said second plurality of twisted pair conductors and said jacket.

3. The high speed telecommunication cable as claimed in claim 2 wherein said layer of shielding material is an electrically conductive material.

4. The high speed telecommunication cable as claimed in claim 1; wherein said second plurality of twisted pair conductors are wound about said soft support means.

5. The high speed telecommunication cable as claimed in claim 1; wherein said soft support means includes a first soft support means and a second soft support means.

6. The high speed telecommunication cable as claimed in claim 5; wherein said second plurality of twisted pair conductors is separated into first and second groups, said first and second groups including a single layer of said second plurality of twisted pair conductors about said first and second soft support means, respectively, and wherein said first plurality of twisted pair conductors is separated into third and fourth groups, said third and fourth groups being embedded in said first and second soft support means, respectively.

7. The high speed telecommunication cable as claimed in claim 6 wherein said first and second soft support means each has an equal number of said second plurality of twisted pair conductors wrapped thereabout.

8. The high speed telecommunication cable as claimed in claim 6 wherein the number of said first plurality of twisted pair conductors in said third and fourth groups is unequal.

9. The high speed telecommunication cable as claimed in claim 1 wherein there are three at said soft support means, wherein said first plurality of twisted pair conductors is separated into three groups, each group being embedded in one of said three soft support means, two of said three soft support means have seven of said second plurality of twisted pair conductors wound thereabout and one of said three soft support means has eight of said second plurality of twisted pair conductors wound thereabout.

10. The high speed telecommunications cable as claimed in claim 9 further comprising: a fourth soft support means not having any of said first plurality of twisted pair conductors embedded therein, said three soft support means having said second twisted pair conductors wound thereabout surrounding said fourth soft support means.

11. The high speed telecommunication cable as claimed in claim 10 wherein each of said three soft support means encompasses at least one of said first plurality of twisted pair conductors.

12. The high speed telecommunication cable as claimed in claim 11 wherein said fourth soft support means encompasses at least one of said first plurality of twisted pair conductors.

13. The high speed telecommunication cable as claimed in claim 9 wherein each of said three soft support means encompasses at least one of said first plurality of twisted pair conductors.

14. The high speed telecommunication cable as claimed in claim 1 wherein said soft support means is formed from flame retardant polypropylene.

* * * * *